US008556785B1

(12) United States Patent
Ihli et al.

(10) Patent No.: US 8,556,785 B1
(45) Date of Patent: Oct. 15, 2013

(54) GOLF EXERCISE METHODS AND APPARATUS

(76) Inventors: Stephen P. Ihli, Santa Monica, CA (US); Mark A. Krull, New Braunfels, TX (US)

( * ) Notice: Subject to any disclaimer, the term of this patent is extended or adjusted under 35 U.S.C. 154(b) by 395 days.

(21) Appl. No.: 12/927,256

(22) Filed: Nov. 10, 2010

Related U.S. Application Data

(60) Provisional application No. 61/281,016, filed on Nov. 12, 2009.

(51) Int. Cl.
*A63B 21/015* (2006.01)
*A63B 21/045* (2006.01)

(52) U.S. Cl.
USPC ..... 482/126; 482/116; 482/91

(58) Field of Classification Search
USPC ..... 482/91–92, 109, 121–129, 148
See application file for complete search history.

(56) References Cited

U.S. PATENT DOCUMENTS 766,743 A 8/1904 Terry
913,799 A 3/1909 Burguet
1,390,095 A * 9/1921 Dettinger et al. ..... 607/78
1,573,362 A * 2/1926 Stovall ..... 482/148
1,954,762 A * 4/1934 Wolff ..... 482/127
2,951,702 A * 9/1960 Goodwin ..... 482/127
2,959,414 A * 11/1960 Saltz ..... 482/127
3,841,627 A * 10/1974 Vetter ..... 482/110
3,885,789 A * 5/1975 Deluty et al. ..... 482/120
4,174,832 A * 11/1979 Thompson ..... 482/120
4,253,663 A * 3/1981 Hughes ..... 482/127
4,328,965 A * 5/1982 Hatfield ..... 482/122
4,625,962 A * 12/1986 Street ..... 482/116
4,779,866 A * 10/1988 Marshall et al. ..... 482/116
4,940,227 A * 7/1990 Coffey ..... 482/73
4,948,119 A * 8/1990 Robertson, Jr. ..... 482/56
5,007,635 A * 4/1991 Tiller ..... 482/129
5,158,299 A * 10/1992 Otter ..... 473/229
5,226,867 A * 7/1993 Beal ..... 482/127
5,234,395 A * 8/1993 Miller et al. ..... 482/118
5,324,243 A * 6/1994 Wilkinson ..... 482/92
5,358,461 A * 10/1994 Bailey, Jr. ..... 482/2
5,437,591 A * 8/1995 Chen ..... 482/127
5,486,149 A * 1/1996 Smith et al. ..... 482/120
5,509,873 A * 4/1996 Corn ..... 482/74
5,618,249 A * 4/1997 Marshall ..... 482/127
5,628,695 A * 5/1997 Worthington et al. ..... 473/229
5,709,637 A * 1/1998 Gow et al. ..... 482/129
5,733,231 A * 3/1998 Corn et al. ..... 482/120
5,755,646 A * 5/1998 Chu ..... 482/118
5,792,034 A * 8/1998 Kozlovsky ..... 482/124
5,876,310 A * 3/1999 Mackey et al. ..... 482/74
6,099,447 A * 8/2000 Ramsaroop ..... 482/127
6,149,559 A * 11/2000 Mackey ..... 482/124
6,283,899 B1 * 9/2001 Charnitski ..... 482/110
6,315,701 B1 * 11/2001 Shifferaw ..... 482/114

(Continued)

OTHER PUBLICATIONS

U.S. Appl. No. 12/927,252, Portable Exercise Apparatus and Methods.

(Continued)

*Primary Examiner* — Stephen Crow

(57) ABSTRACT

Golf swing exercises are performed with left and right resistance devices proximate a person's left and right feet, respectively. Left and right flexible members extend from respective left and right resistance device housings to a lower portion of a golf club handle.

19 Claims, 19 Drawing Sheets

(56) References Cited

U.S. PATENT DOCUMENTS

| | | | | |
|---|---|---|---|---|
| 6,537,184 | B2 * | 3/2003 | Kim | 482/122 |
| 6,544,152 | B2 * | 4/2003 | Rosati | 482/126 |
| 6,558,302 | B2 * | 5/2003 | Cluff | 482/129 |
| 6,726,607 | B1 * | 4/2004 | Ihli | 482/127 |
| 6,770,014 | B2 * | 8/2004 | Amore | 482/92 |
| 7,048,638 | B2 * | 5/2006 | Novotny | 473/219 |
| 7,074,131 | B1 * | 7/2006 | Renaud | 473/219 |
| 7,087,001 | B1 * | 8/2006 | Ihli | 482/115 |
| 7,134,968 | B1 * | 11/2006 | Pryor | 473/257 |
| 7,250,021 | B2 * | 7/2007 | Leight | 482/116 |
| 7,322,909 | B1 * | 1/2008 | Loccarini et al. | 482/129 |
| 7,364,516 | B2 * | 4/2008 | Kim | 473/409 |
| 2003/0211920 | A1 * | 11/2003 | Mandel | 482/116 |
| 2006/0040805 | A1 * | 2/2006 | Wilkinson | 482/124 |
| 2006/0100071 | A1 * | 5/2006 | Elmhirst | 482/139 |

OTHER PUBLICATIONS

U.S. Appl. No. 12/927,253, Exercise Resistance Methods and Apparatus.
U.S. Appl. No. 12/927,254, Exercise Methods and Apparatus.
U.S. Appl. No. 12/927,255, Exercise Shoe Methods and Apparatus.
U.S. Appl. No. 12/927,256, Golf Exercise Methods and Apparatus.
U.S. Appl. No. 12/927,257, Exercise Apparatus and Methods.

* cited by examiner

GOLF EXERCISE METHODS AND APPARATUS

CROSS-REFERENCE TO RELATED APPLICATION

Disclosed herein is subject matter that is entitled to the filing date of U.S. Provisional Application No. 61/281,016, filed Nov. 12, 2009.

FIELD OF THE INVENTION

The present invention relates to golf exercise methods and apparatus, and more specifically, to exercising muscles associated with a person's golf swing and exercising in a manner that improves a person's golf swing.

BACKGROUND OF THE INVENTION

An object of the present invention is to provide exercise methods and apparatus for exercising muscles associated with a person's golf swing and exercising in a manner that improves a person's golf swing. Another object of the present invention is to provide improved golf swing exercising and training devices.

SUMMARY OF THE INVENTION

According to one aspect of the present invention, a person practices his golf swing by assuming a conventional golf stance with a first resistance device secured in place proximate his left toes, and with a second resistance device secured in place proximate his right toes. A flexible member from the first resistance device is secured to a golf club handle, and a flexible member from the second resistance device is secured to the golf club handle. The person then moves the golf club handle in a manner consistent with at least a portion of a conventional golf swing.

According to another aspect of the present invention, a base is sized and configured to rest on a flat underlying surface and to accommodate a person's left foot and right foot in a conventional golf stance. A first resistance device is mounted to the base proximate the person's left foot, and a second resistance device is mounted to the base proximate the person's right foot. Each resistance device includes a respective flexible member having a distal end connected to a handle. The handle is sized and configured to accommodate a person's left hand and right hand in a conventional golf grip.

According to yet another aspect of the present invention, a base is configured to be screwed into turf and underlying dirt, and a resistance device is secured to the base. The resistance device includes a flexible member connected to a force receiving member. According to still another aspect of the present invention, one such base is secured in place proximate the left toes of a person occupying a conventional golf stance, and another such base is secured in place proximate the right toes of a person occupying a conventional golf stance. The force receiving member includes at least a golf grip sized and configured to accommodate a person's left and right hands in a conventional grip, and a location for attaching each flexible member to the golf grip.

Each of the above-described resistance devices preferably includes a rotatable sheave for its flexible member, and a rewind spring that biases the flexible member toward a retracted position onto the sheave. Also, such devices are preferably releasably secured to their respective bases, and may be removed and "palmed" to perform various known muscles strengthening and/or toning exercises. Additional features and advantages of the present invention will become apparent from the more detailed description that follows.

BRIEF DESCRIPTION OF THE DRAWING

With reference to the Figures of the Drawing, wherein like numerals represent like parts and assemblies throughout the several views:

FIG. 4 is a perspective view of a fastener that is among the components shown in FIG. 3;

DETAILED DESCRIPTION OF THE PREFERRED EMBODIMENT

Figure 1:
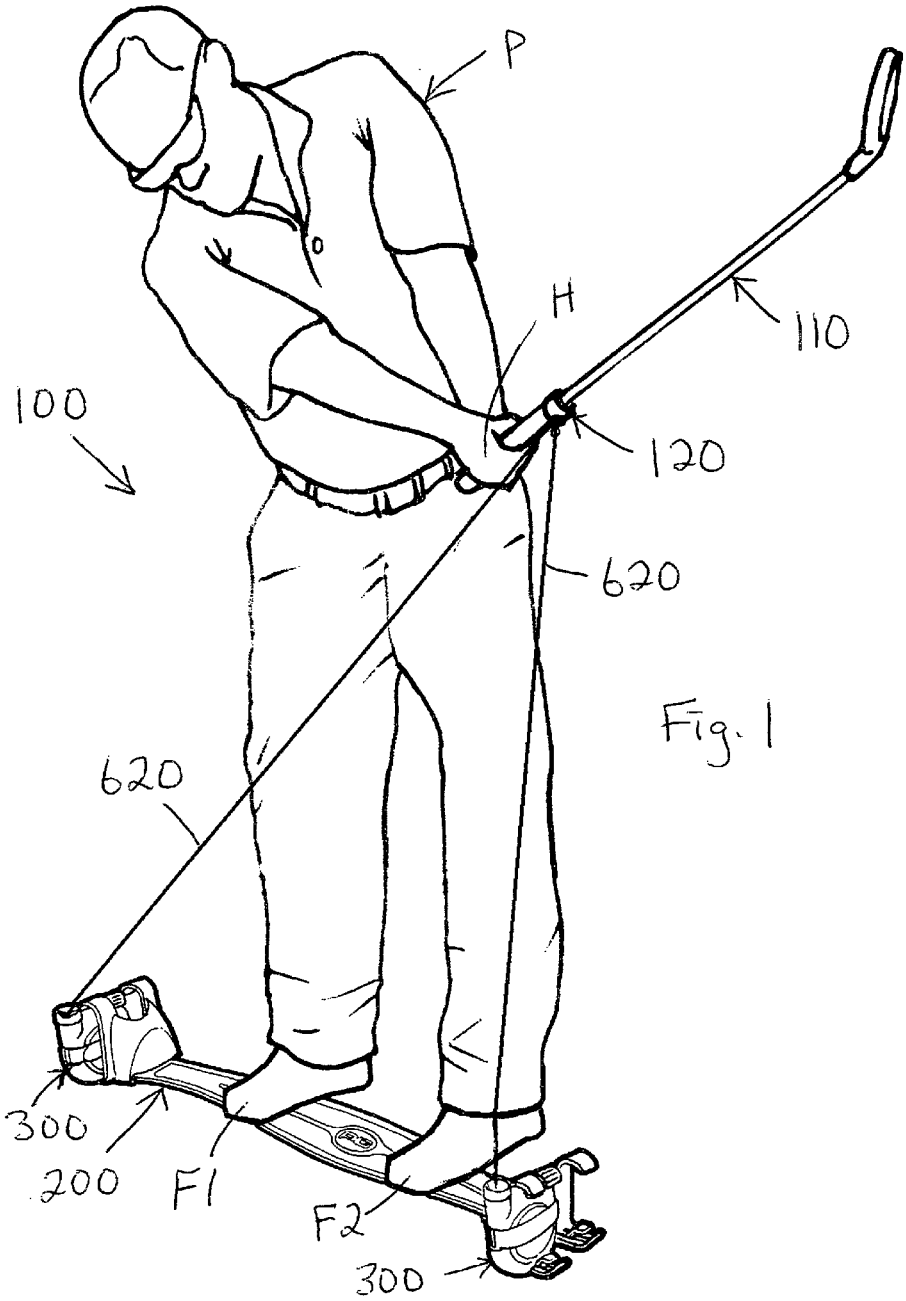
FIG. 1 is a perspective view of a person performing a golf swing exercise with an exercise apparatus constructed according to the principles of the present invention.

FIG. 1 shows a person P performing a golf swing exercise in accordance with the principles of the present invention.

The person P has assumed a conventional golf stance with a first resistance device 300 secured in place proximate his left foot F1, and with a second resistance device 300 secured in place proximate his right foot F2. A flexible member 620 emanates from the first resistance device 300 and is connected to the handle of an otherwise conventional golf club 110. Similarly, a flexible member 620 emanates from the second resistance device 300 and is connected to the handle of the golf club 110. With his hands H occupying a conventional grip on the handle of the golf club 110, the person P has moved the golf club 110 in a manner consistent with at least a portion of a conventional golf swing.

Figure 2:
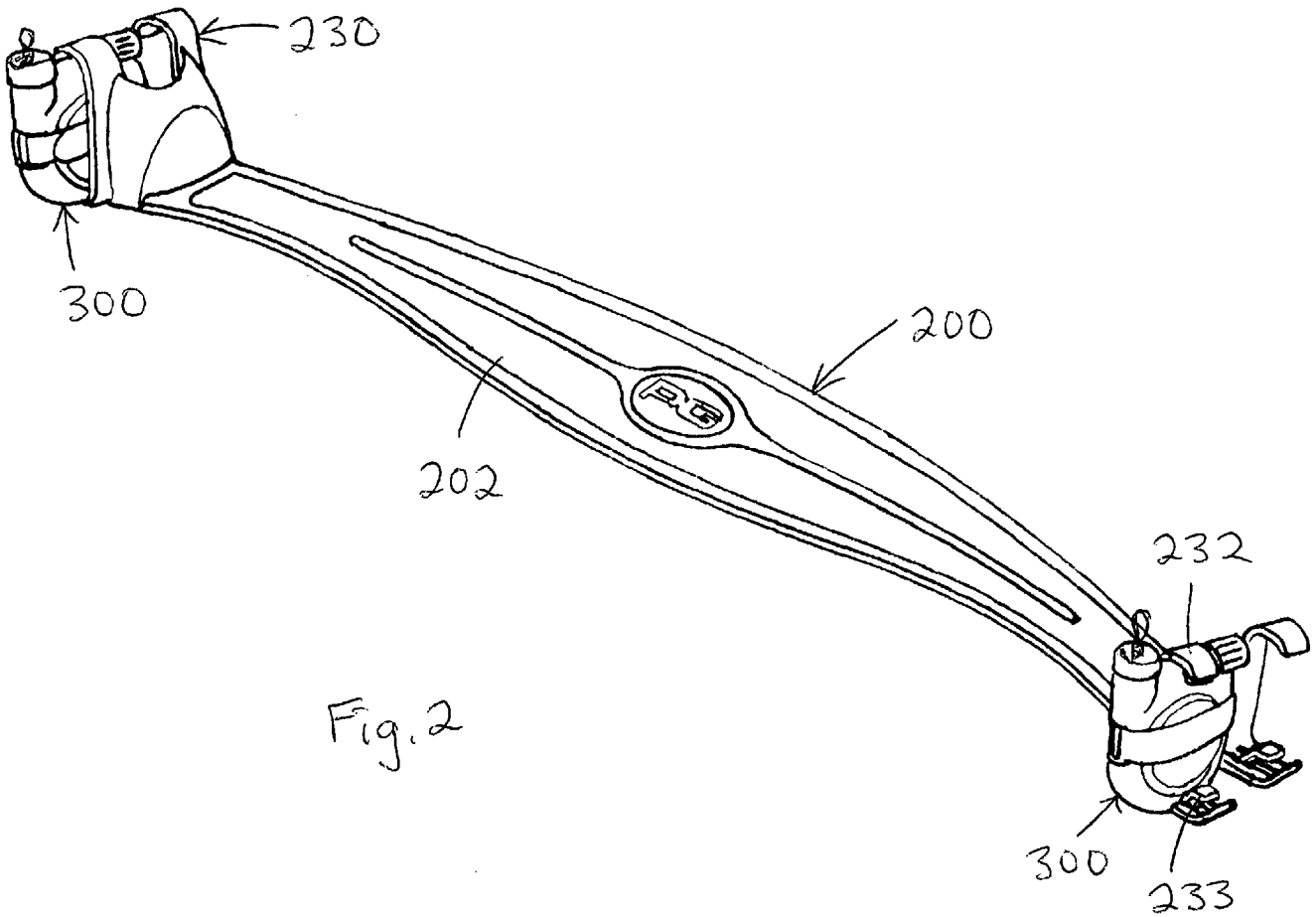
FIG. 2 is a perspective view of the exercise apparatus of FIG. 1.

Each resistance device 300 is mounted on a respective end of a base member 200. FIG. 2 shows the base member 200 and the resistance devices 300 in isolation. The base member 200 may be described in terms of a foot strip or platform 202, and receptacles or anchors 230 secured to opposite ends of the platform 202. The platform 202 is preferably stamped from a sheet of steel and configured to lie flat on an underlying support surface. Also, the platform 202 is sized and configured to support the feet F of a person P assuming a range of conventional golf stances, one of which is shown in FIG. 1, for example.

Each receptacle 230 is preferably injection molded plastic that is secured to the platform 202 by suitable fasteners, such as screws, for example. As further discussed below with reference to the resistance devices 300, each receptacle 320 is sized and configured to selectively receive and retain a resistance device 300 in a manner that is reliable and convenient. On the embodiment shown in FIG. 2, two receptacles 230 are disposed at each end of the platform 202 to define alternative mounting locations for the resistance devices 300. Persons skilled in the art will recognize that alternative embodiments of the present invention may be constructed with only one receptacle 230 at each end of the platform 202.

Figure 3:
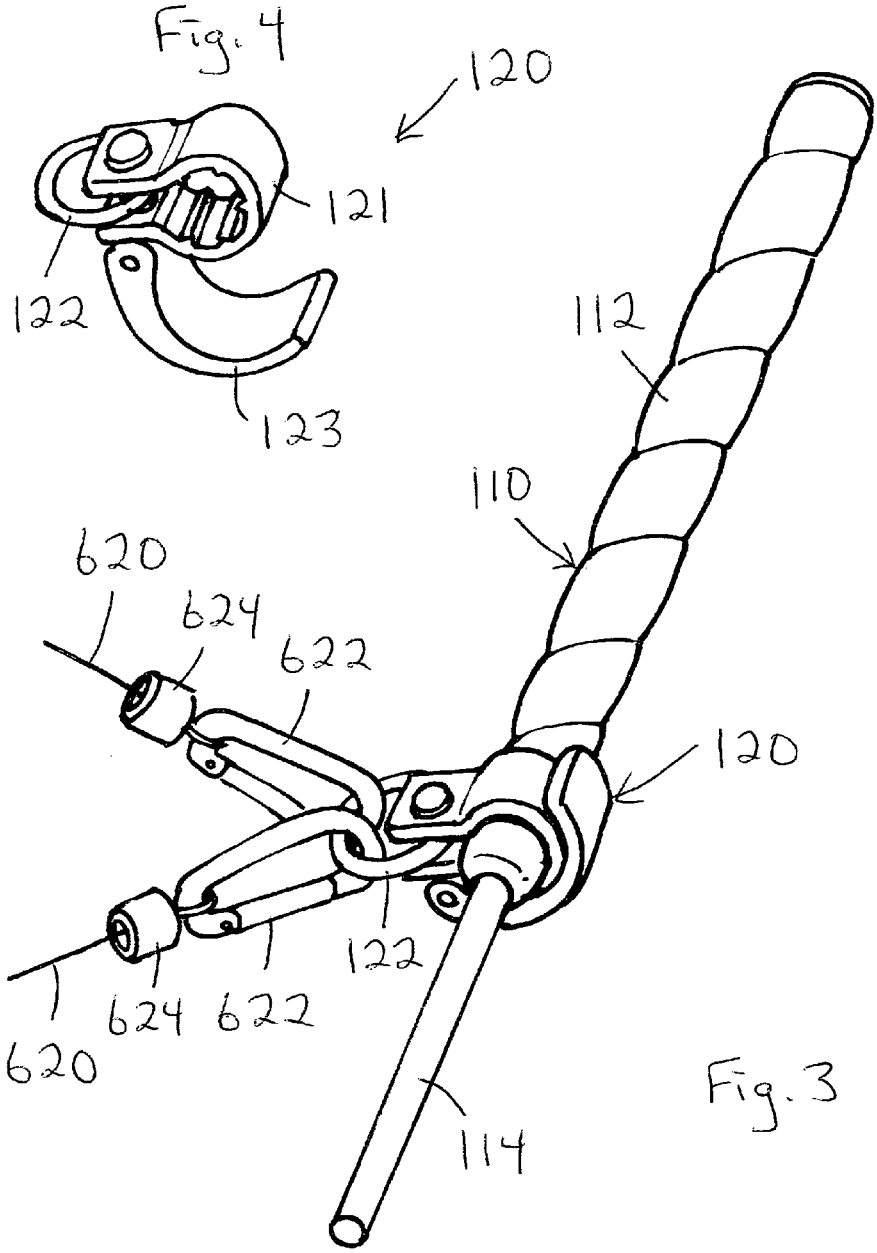
FIG. 3 is a fragmented view of certain components of the exercise apparatus of FIG. 1.

FIGS. 3-4 show how the cables 620 are connected to the golf club 110 in FIG. 1. A respective carabineer 622 is secured to a distal end of each flexible member 620, and both carabineers 622 are secured to a fastener 120 via a ring 122. The ring 122 is connected to a clamp 121 via a rivet or other suitable means. The fastener also includes a lever 123 that is movably connected to the clamp 121 for movement between a squeezing position and a release position. The clamp 121 is sized and configured to fit onto the hand grip portion 112 of the golf club 110 when the lever occupies the release position, and to firmly squeeze the hand grip portion 112 when the lever occupies the squeezing position. As shown in FIG. 3, the fastener 120 is preferably secured to the golf club 110 proximate a juncture defined between a lower end of the hand grip portion 112 and an upper end of the shaft portion 114 of the club 110.

Figure 5:
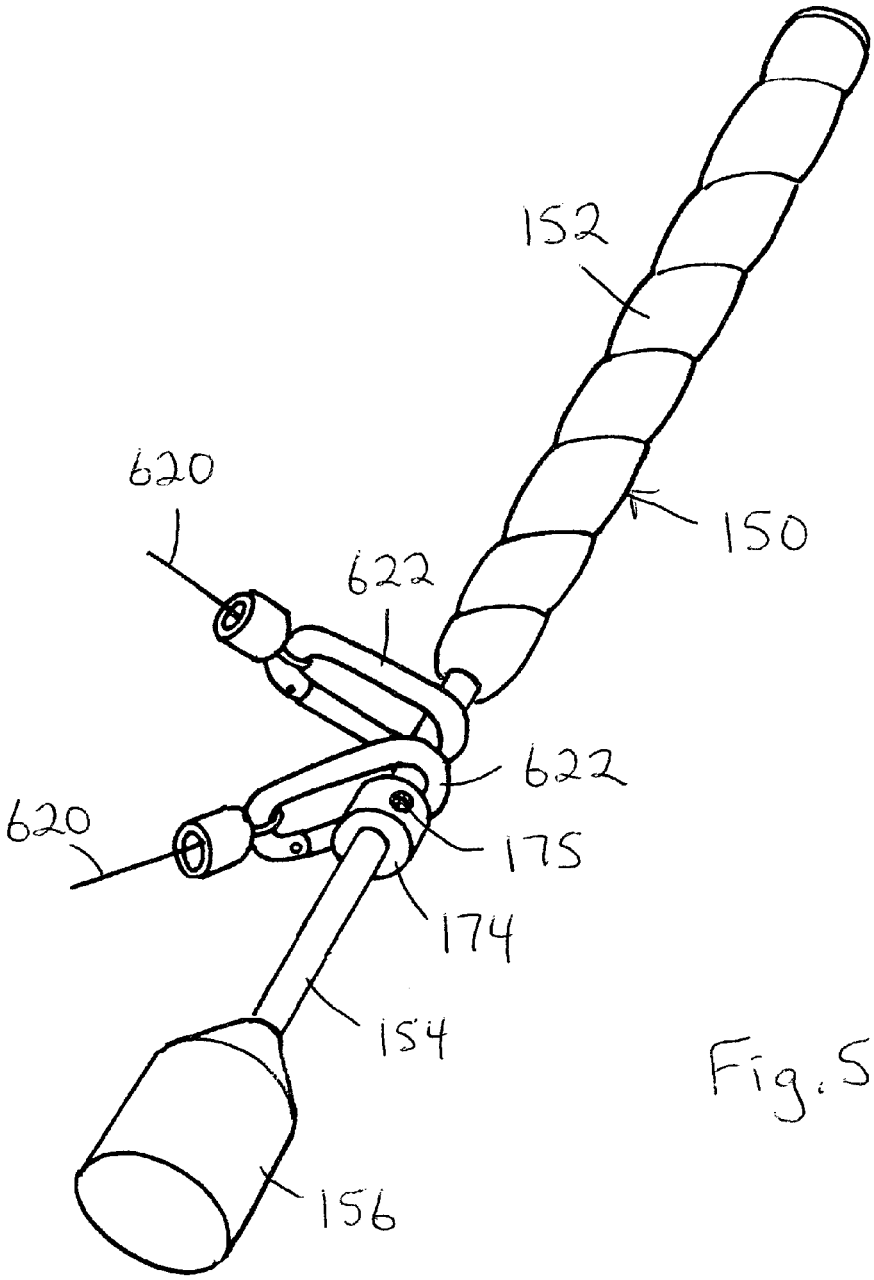
FIG. 5 is a perspective view of an alternative fastener arrangement suitable for use on alternative embodiments of the present invention.

FIG. 5 shows an alternative fastener arrangement for securing the flexible members 620 to a golf club handle 150. On this embodiment, the golf club handle 150 is not part of a conventional golf club, but instead, is part of an alternative embodiment force receiving member that can be used indoors to practice golf club swings. The force receiving member 150 includes a hand grip portion 152, a truncated shaft 154, and a weight 156 at the lower end of the truncated shaft 154. A collar 174 is secured to the shaft 154 via a set screw 175, and the carabineers 622 are secured about the shaft 154 between the collar 174 and the handle grip portion 152. On another alternative embodiment, a ring (like ring 122 is provided on collar (like collar 174), and the carabineers 622 are secured to the ring. Persons skilled in the art will also recognize that the different force receiving members may be mixed and matched with these and other fastener arrangement to arrive at additional alternative embodiments of the subject invention.

Figure 7:
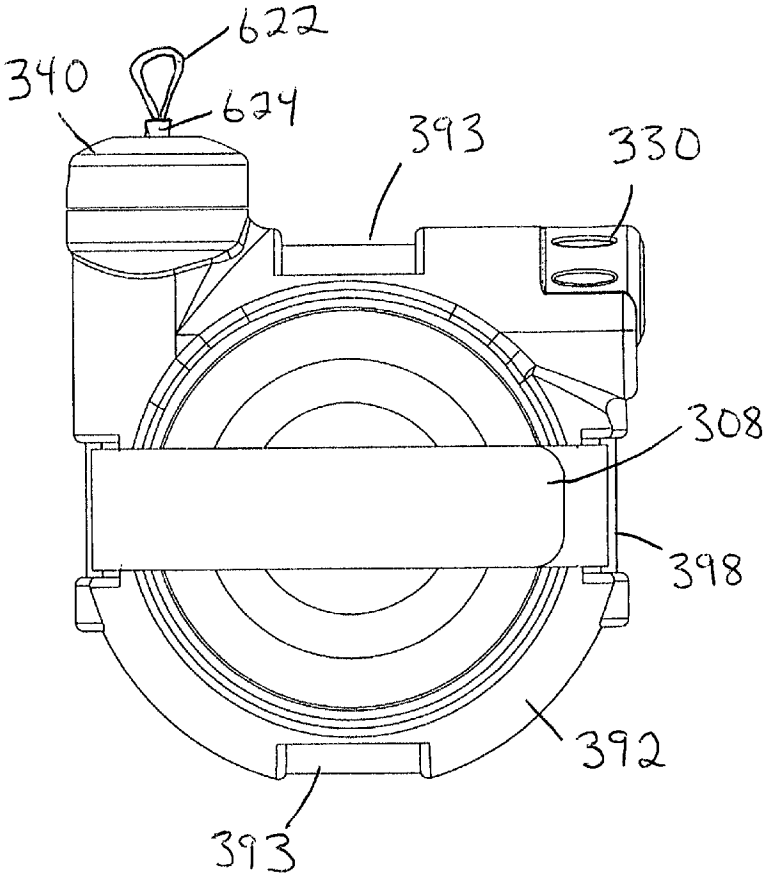
FIG. 7 is a front view of the resistance device of FIG. 6.
Figure 6:
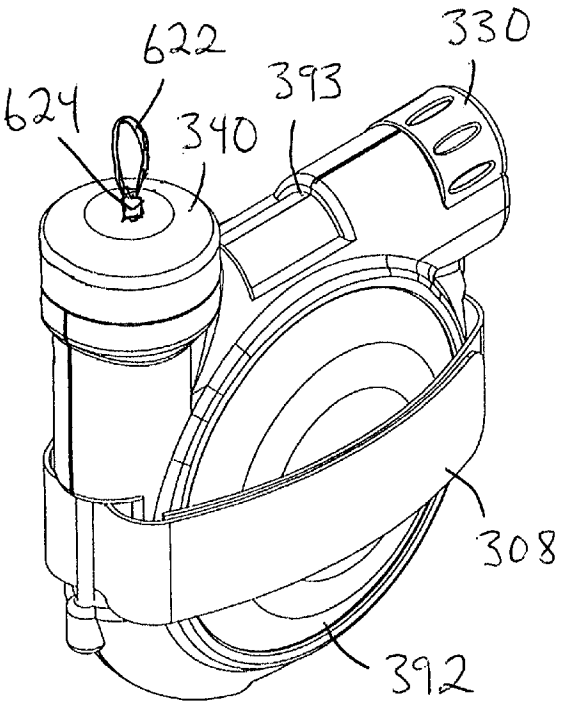
FIG. 6 is a perspective view of one of two resistance devices that are components of the exercise apparatus of FIG. 1.

FIGS. 6-7 show one of the resistance devices 300 by itself. Each resistance device 300 provides resistance in the same manner as an alternative embodiment resistance device 600 described below with reference to FIGS. 8-9. Also, in some respects, including certain aspects of construction, operation, and use, the resistance devices 300 and 600 are comparable to those disclosed in U.S. Pat. No. 6,726,607 to Ihli, and U.S. Pat. No. 7,087,001 to Ihli, both of which are incorporated herein by reference.

Generally speaking, the resistance device 300 includes a housing 392 and a flexible member 620 (shown in FIGS. 1 and 8-9) that is selectively extracted from the housing 392 and retracted into the housing 392. A re-directional bearing 340 is movably mounted on the housing 392, and the flexible member 620 is routed through the re-directional bearing 340. One end of the flexible member 620 is connected to a bead or stop 622, and an opposite end of the flexible member 620 is secured to a sheave 680 (shown in FIGS. 8-9). A rewind spring 690 (shown in FIG. 9) is interconnected between the sheave 680 and the housing 392 to encourage the flexible member 620 to wind onto the sheave 680. A band brake arrangement (shown in FIG. 8) resists removal of the flexible member 820 from the sheave 680. An adjustment knob 330 is movably mounted on the housing 392 and rotatable to adjusted resistance provided by the band brake arrangement. On other embodiments, different types of resistance arrangements may be used in the alternative.

The housing 392 defines an externally facing periphery, including notches 393 at 12:00, 3:00, 6:00, and 9:00, which matches an internally facing periphery defined by the receptacle 230. In this regard, the receptacle 230 includes a generally C-shaped bracket 232 having an integral leaf spring latch 233 disposed at its lower end. The upper end of the housing 392 is fed into the upper end of the bracket 232, and then the lower end of the housing 392 is pushed past the latch 233 to arrive at the arrangement shown in FIGS. 1-2. In other words, the 12:00 notch 393 in the housing 392 is sized and configured to receive the upper end of the bracket 232, and the 6:00 notch 393 in the housing 392 is sized and configured to receive the latch 233.

The notches 393 at 3:00 and 9:00 are interrupted by respective steel pins 398 that cooperate with the main body of the housing 392 to define strap receiving slots. A strap 308 is selectively inserted through each slot and secured to itself via hook and loop type fasteners. When the strap 308 is removed from the housing 392, the housing may be secured in alternative orientations relative to the receptacles 230. When secured to the housing as shown in FIGS. 6-7, the strap 308 accommodates usage of the resistance device 300 for alternative exercises, as suggested by FIG. 24, for example, which shows a person Q using comparable resistance devices 600 (discussed below).

Figure 24:
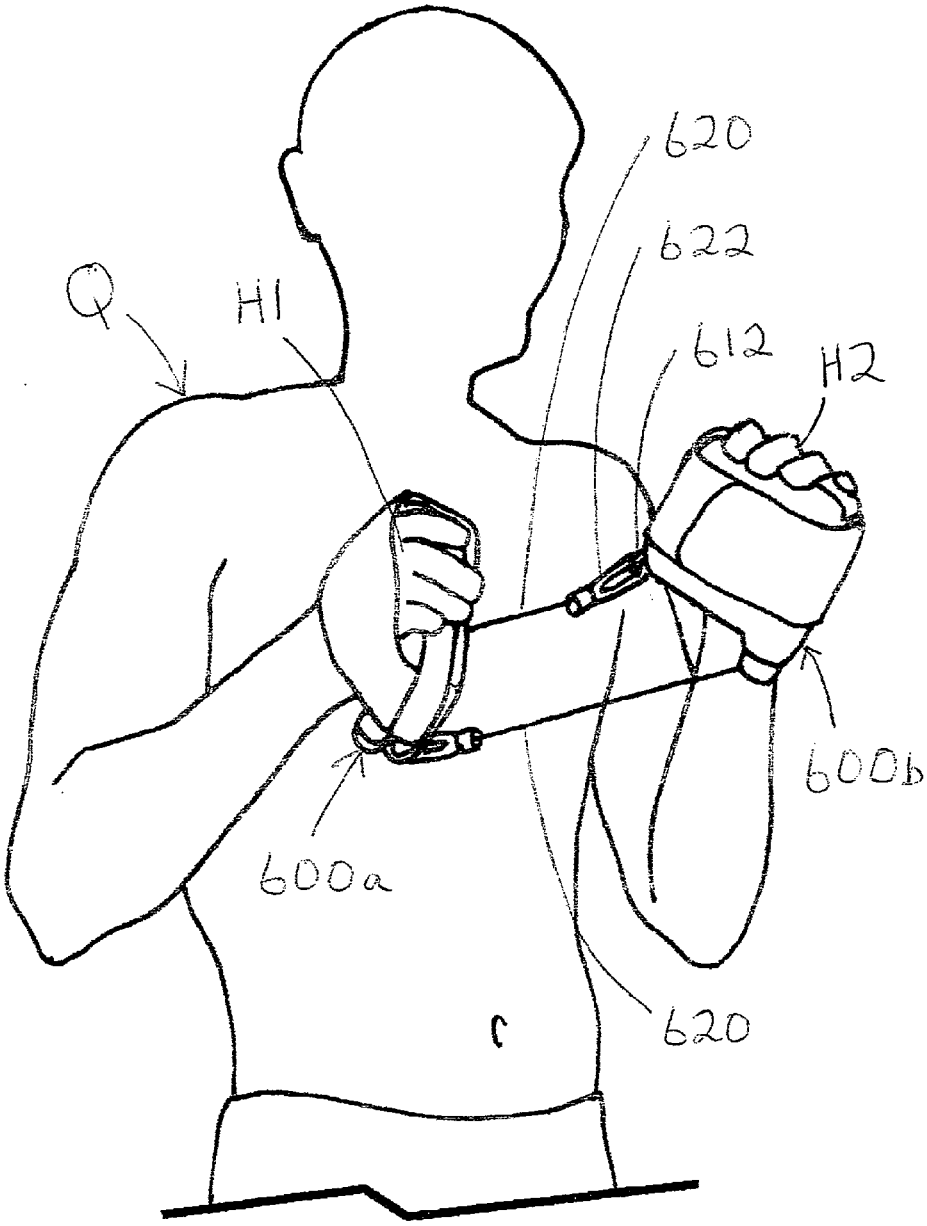
FIG. 24 is a perspective view of a person performing an arm exercise with two of the resistance devices shown in FIGS. 8-9.

FIG. 24 shows a person Q holding a resistance device 600*a* in his right hand H1, and holding a resistance device 600*b* in his left hand H2. Also, the two units 600*a* and 600*b* are connected to one another at respective attachment members 612. In other words, the carabineer 622 on the left unit 600*b* is connected to the attachment member 612 on the right unit 600*a*, and the carabineer 622 on the right unit 600*a* is connected to the attachment member 612 on the left unit 600*b*. When so arranged and held in respective hands H1 and H2 of the person Q, as shown in FIG. 24, the units 600*a* and 600*b* may be used to perform various upper body exercises.

Figure 9:
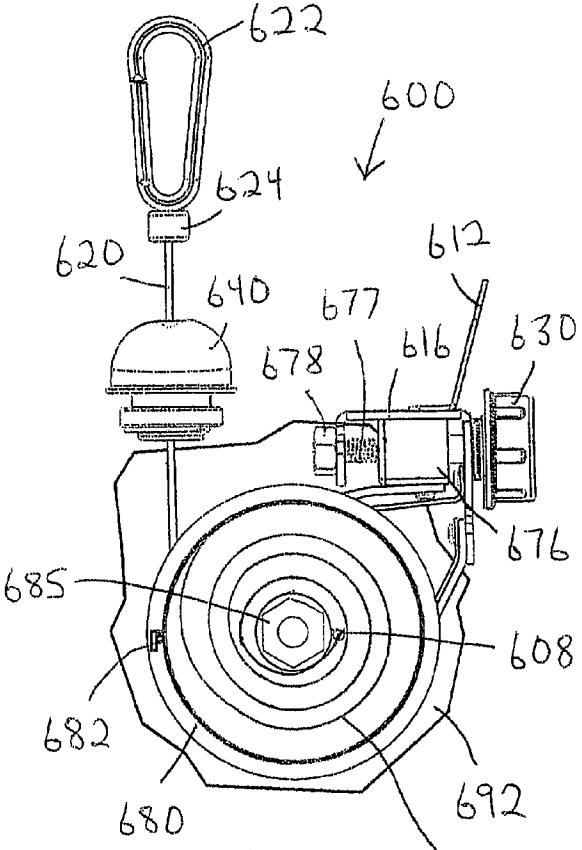
FIG. 9 is another partially sectioned front view of the resistance device of claim 8.
Figure 8:
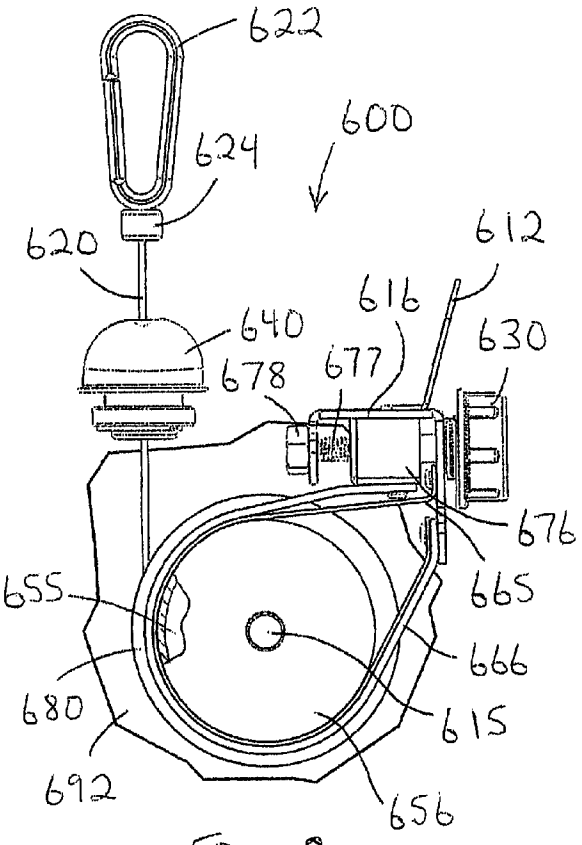
FIG. 8 is a partially sectioned front view of a resistance device constructed according to the principles of the present invention and operationally similar to the resistance device shown in FIGS. 6-7.

FIGS. 8-9 show components of one of the resistance devices 600, which is functionally similar to the resistance devices 300. The resistance device 600 includes a flexible member or resistance cable 620 that is extracted from housing 692 when the extraction force exceeds an adjustable level of resistance, and that is rewound into the housing 692 when tension in the cable 620 falls below the rewind force exerted by the spring 690 within the housing 692.

As shown in FIG. 8, the cable 620 is wound about a sheave 680, which in turn, is mounted on a rotatable shaft 615 via a conventional one-way clutch bearing 685. A hub 655 is rigidly secured to the shaft 615, and a steel cylindrical cap 656 is rigidly mounted on the hub 655 to define a resistance drum. A stainless steel brake band 666 is secured about a portion of the cap 656 with a Keviar brake strip sandwiched therebetween. The brake band 666 cooperates with the resistance drum to provide resistance to rotation of the shaft 615 in either direction.

As shown in FIG. 9, the coiled rewind spring 690 is nested within a compartment defined by the sheave 680. An inner end of the spring 690 is anchored to the housing 692 via a peg 608, and an opposite, outer end of the spring 690 is anchored to the sheave 680 via a flange 682. As a result, the spring 690 biases the sheave 680 to rotate in a first rotational direction relative to the shaft 615 and the housing 692. The sheave 680 rotates together with the shaft 615 and relative to the housing 692 in an opposite, second rotational direction in response to extraction of the cable 620. Thereafter, when the cable 620 is released, the rewind spring 690 rotates the sheave 680 relative to the shaft 615 to retract the cable 620 within the housing 692.

A knob 630 is rotatably mounted on an end of the housing 692, and rotates relative to the housing 692 to adjust the level of resistance associated with the resistance drum. The housing 692 includes a bracket or frame member 616 that is preferably a stamped metal part. The frame member 616 is preferably secured in place between opposing "halves" of the housing 692 by means of internal structure on the housing shells, as well as fasteners that secure the halves to one another. A first rivet or other suitable fastener secures a first end of the brake strip 665 to a first portion of the frame member 616. A second rivet or other suitable fastener secures an opposite, second end of the brake strip 665 to a discrete, second portion of the frame member 616. The second rivet also preferably secures an end of the tension band 666 to the second portion of the frame member 616.

An opposite end of the tension band 666 is secured to a slide block 676 by means of a separate fastener, which is preferably a screw. The slide block 676 is threaded onto a bolt 677, and the slide block 676 bears against the frame member 616 in a manner that prevents rotation while allowing linear travel of the former relative to the latter. The bolt 677 is rotatably mounted within upper and lower openings in the frame member 616. An upper end of the bolt 677 is keyed to the knob 630, and a lower end of the bolt 677 is rigidly fastened to a nut 678. A thrust bearing is preferably disposed between the knob 630 and the frame member 616 to accommodate relative rotation therebetween. The foregoing elements cooperate to rotatably mount the bolt 677 in a specific position relative to the frame. A lower end of the frame member 616 is configured and arranged to limit downward travel of the slide block 676 along the bolt 677. On an alternative embodiment, a pin or other suitable stop is preferably secured to a lower section of the bolt 677 to function as the stopping means.

When the knob 630 is rotated in a first direction, tension in the tension band 666 increases, and when the knob 630 is rotated in an opposite, second direction, tension in the tension band 666 decreases. In either case, tension in the brake material 665 remains relatively unaffected, while compression of the brake material 665 against the cap 656 increases or decreases in direct relation to the change in tension in the tension band 666. On a working embodiment of the device 600, the resulting resistance is smooth and predictable through a range of resistance from 2 to 40 pounds in response to less than two full rotations of the knob 630.

A re-directional bearing assembly 640 is movably mounted on top of the housing 692, and the cable 620 is routed through the re-directional bearing assembly 640 to accommodate extraction of the cable 620 in any direction having an upward component relative to the top of the housing 692. Persons skilled in the art will recognize that the re-directional bearing 640 is located at one of six available "corner locations" on the housing 692, and furthermore, that it need not occupy an orthogonal or parallel orientation relative to the longitudinal axis of the adjustment bolt 677.

A bead or stop 624 is rigidly secured to an external portion of the cable 620, and the bead 614 is too large to fit through the opening defined by the re-directional bearing assembly 640, thereby preventing the distal end of the cable 620 from becoming lost inside the housing 692. A carabineer clip 622 is connected to an outer distal end of the cable 620 to releasably connect the cable 620 to any of various force receiving members, including a conventional force receiving member, such as the handle shown in FIG. 11 of U.S. Pat. No. 7,087,001, for example.

Figure 10:
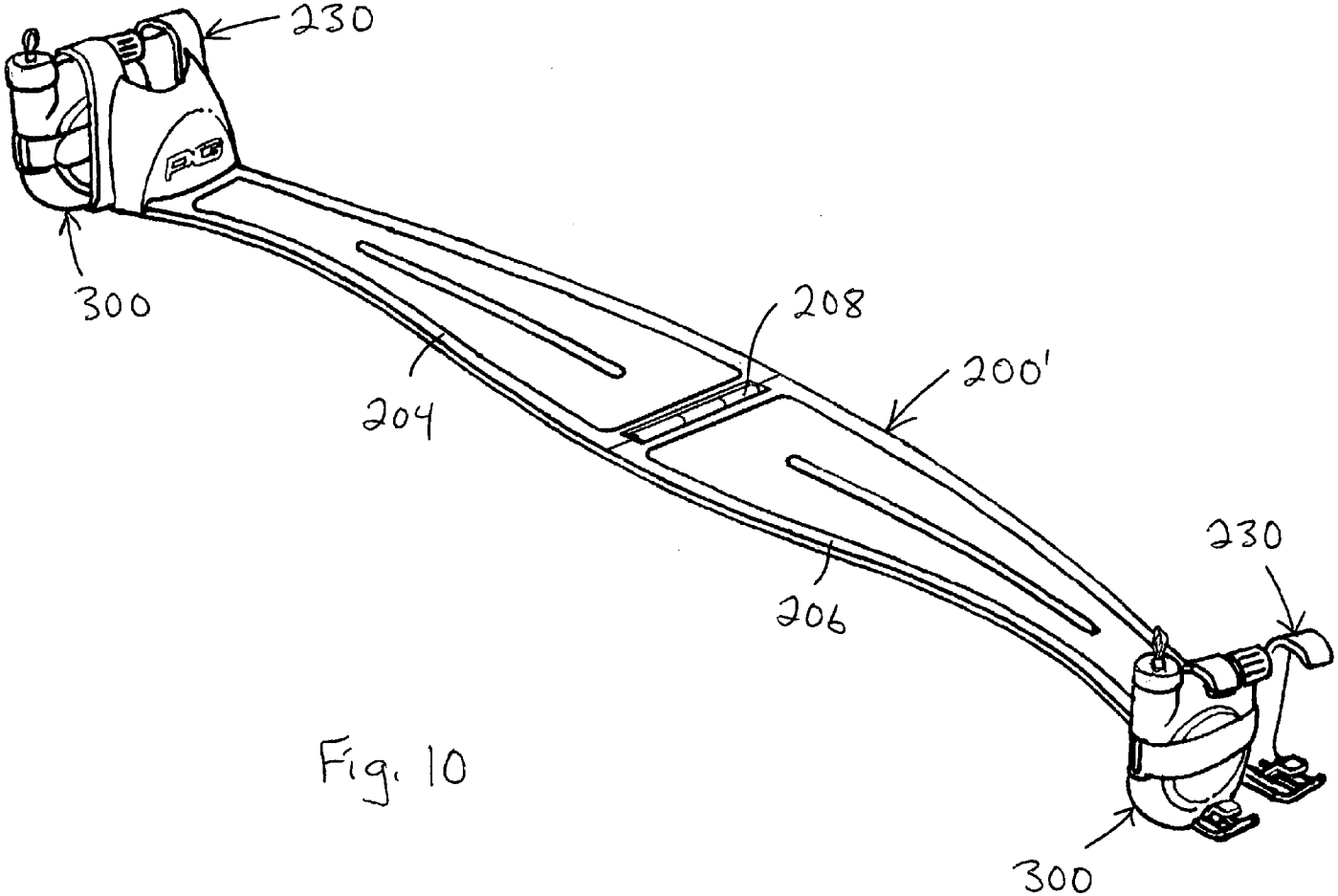
FIG. 10 is a perspective view of an alternative embodiment of the present invention.

FIG. 10 shows an alternative embodiment base member 200'. As suggested by the common reference numerals, the base member 200' is similar in many respects to the base member 200 shown in FIGS. 1-2. In fact, the only difference is that the platform 202 is replaced by left and right platforms 204 and 206, respectively, which are interconnected at hinge 208. As a result, the base member 200' may be folded in half for shipping or storage.

Figures 11, 12:
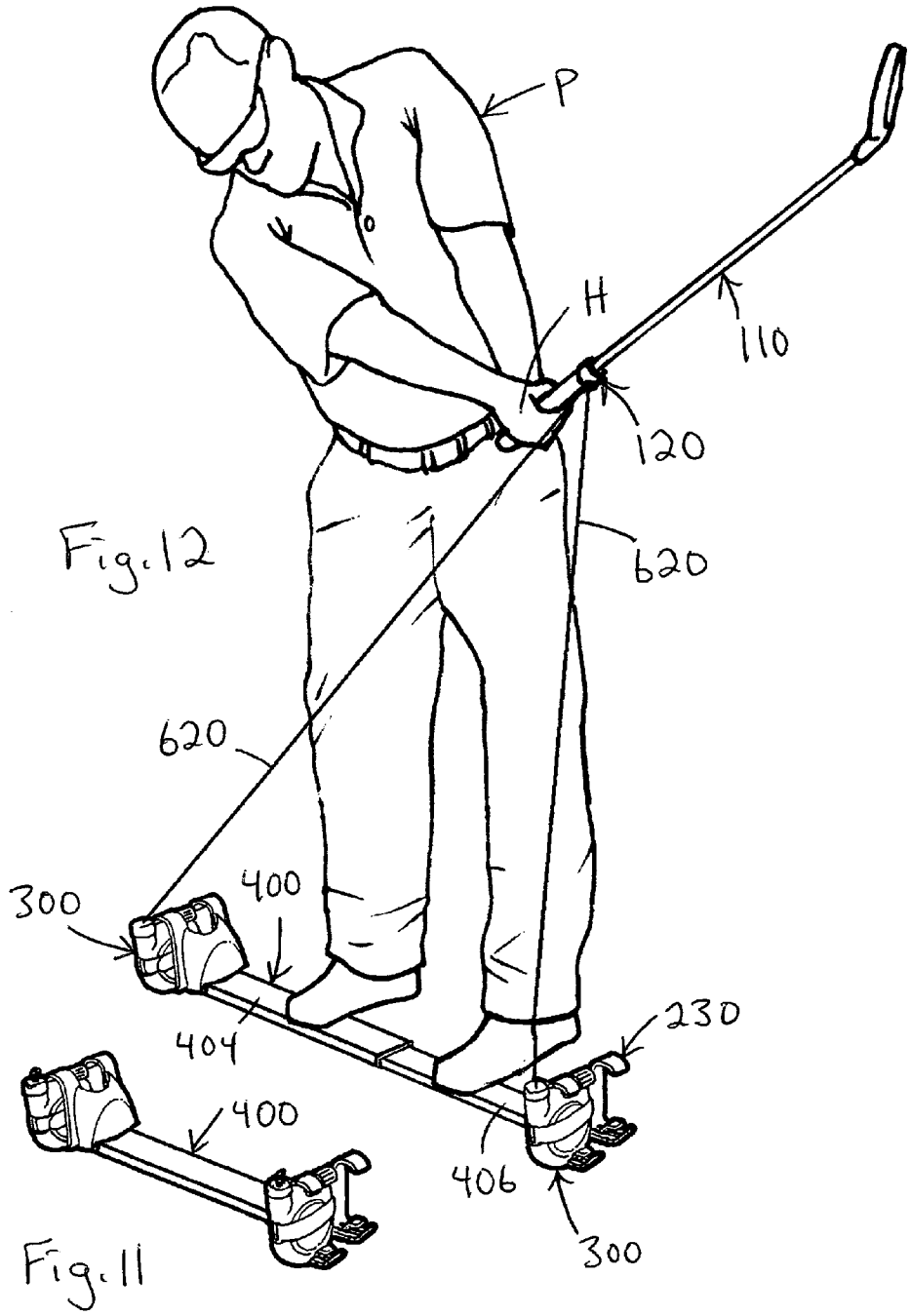
FIG. 11 is a perspective view of another alternative embodiment of the present invention, showing the exercise apparatus in a relatively compact configuration.
FIG. 12 is a perspective view of a person using the exercise apparatus of FIG. 11.
Figure 13:
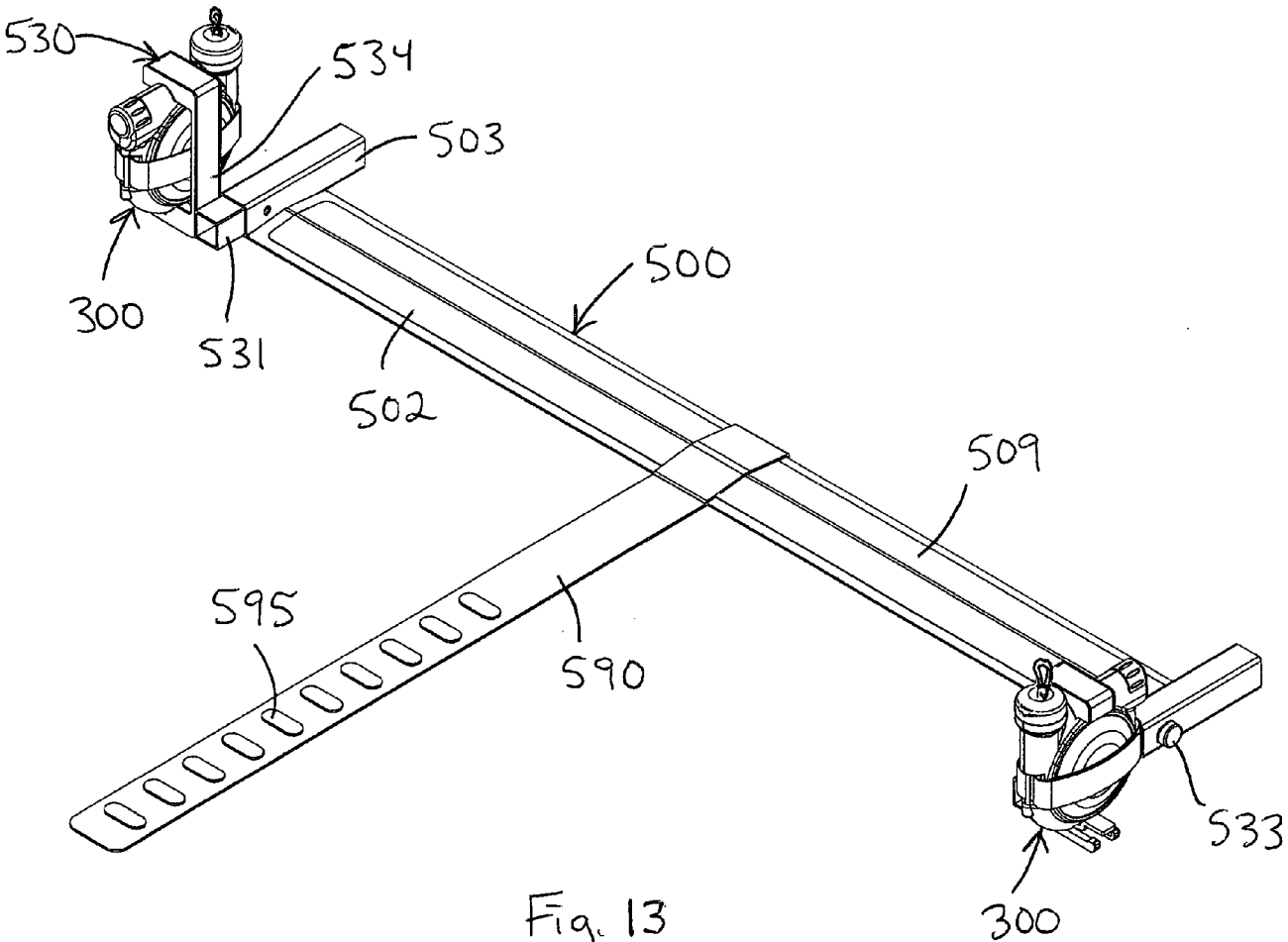
FIG. 13 is a perspective view of another alternative embodiment of the present invention.

FIG. 11 shows another alternative embodiment base member 400. As suggested by the common reference numerals, the base member 400 is similar in many respects to the base member 200 shown in FIGS. 1-2. In fact, the only difference is that the platform 202 is replaced by left and right platforms or base members 404 and 406, respectively, which telescope relative to one another. As a result, the base member 400 may be collapsed almost in half for shipping or storage. A snap button or other suitable fastener is preferably interconnected between aligned holes in the base members 404 and 406 to selectively latch them in any one of several available positions relative to one another.

FIG. 12 shows yet another alternative embodiment base member 500. The base member 500 may be described in terms of a foot strip or platform 502, and receptacles or anchors 530 secured to opposite ends of the platform 502. The platform 502 is preferably an extruded aluminum part that is configured to lie flat on an underlying support surface. Also, the platform 502 is sized and configured to support the feet F of a person P assuming a range of conventional golf stances. An optional traction material 509 is applied to an upwardly facing part of the platform 502. A swing target 509 is secured to an intermediate portion of the platform 502, and indicia 595 are provided on the swing target 590 to allow the person P to practice swinging his club 110 along a particular desired path. On different embodiments, the swing target 590 may be secured to the platform 502, or selectively slidable along the platform 502.

Left and right tubes 503 are secured to respective left and right ends of the platform 502, preferably using screws. Left and right supports 531 are sized and configured to telescope within respective tubes 503 (in a direction perpendicular to the platform 502 and parallel to the swing target 590). At each end of the base member 500, a spring detent pin 533 or other suitable fastener is preferably interconnected between aligned holes in the support 531 and the tube 503 to selectively latch the support 531 in any one of several available positions relative to the tube 503.

Figure 16:
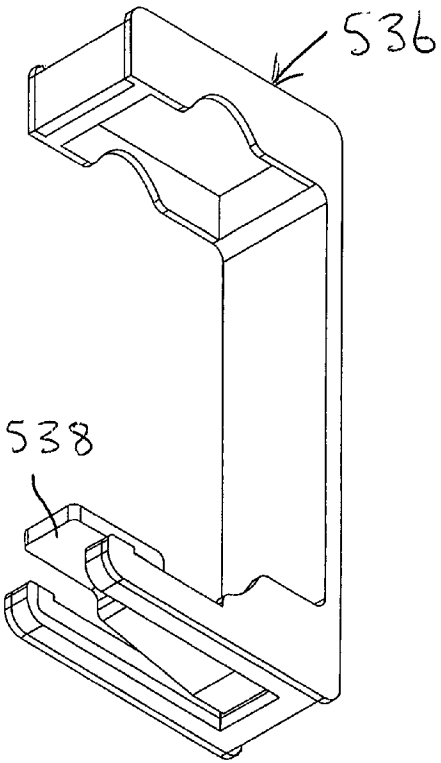
FIG. 16 is another perspective view of the receptacle of FIG. 15.
Figure 15:
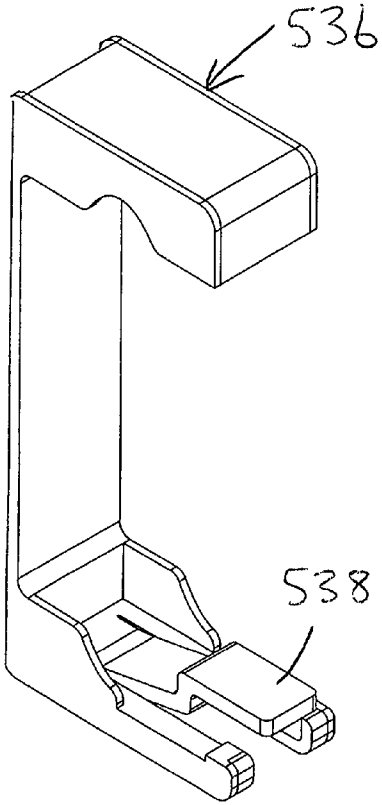
FIG. 15 is a perspective view of a receptacle that is a component of the embodiment shown in FIGS. 13-14.

Each receptacle 530 preferably includes a C-shaped frame member 534 and a somewhat similarly shaped latch member 536 (shown by itself in FIGS. 15-16). The frame member 834 is preferably a flat steel bar that has been formed into the desired configuration, and welded in place onto a support 531. A lower end of the frame member 534 is bifurcated or pronged for reasons discussed below. The latch member 536 is preferably an injection molded plastic part that fits into the frame member 534, and that is preferably secured in place by at least one screw.

Figure 14:
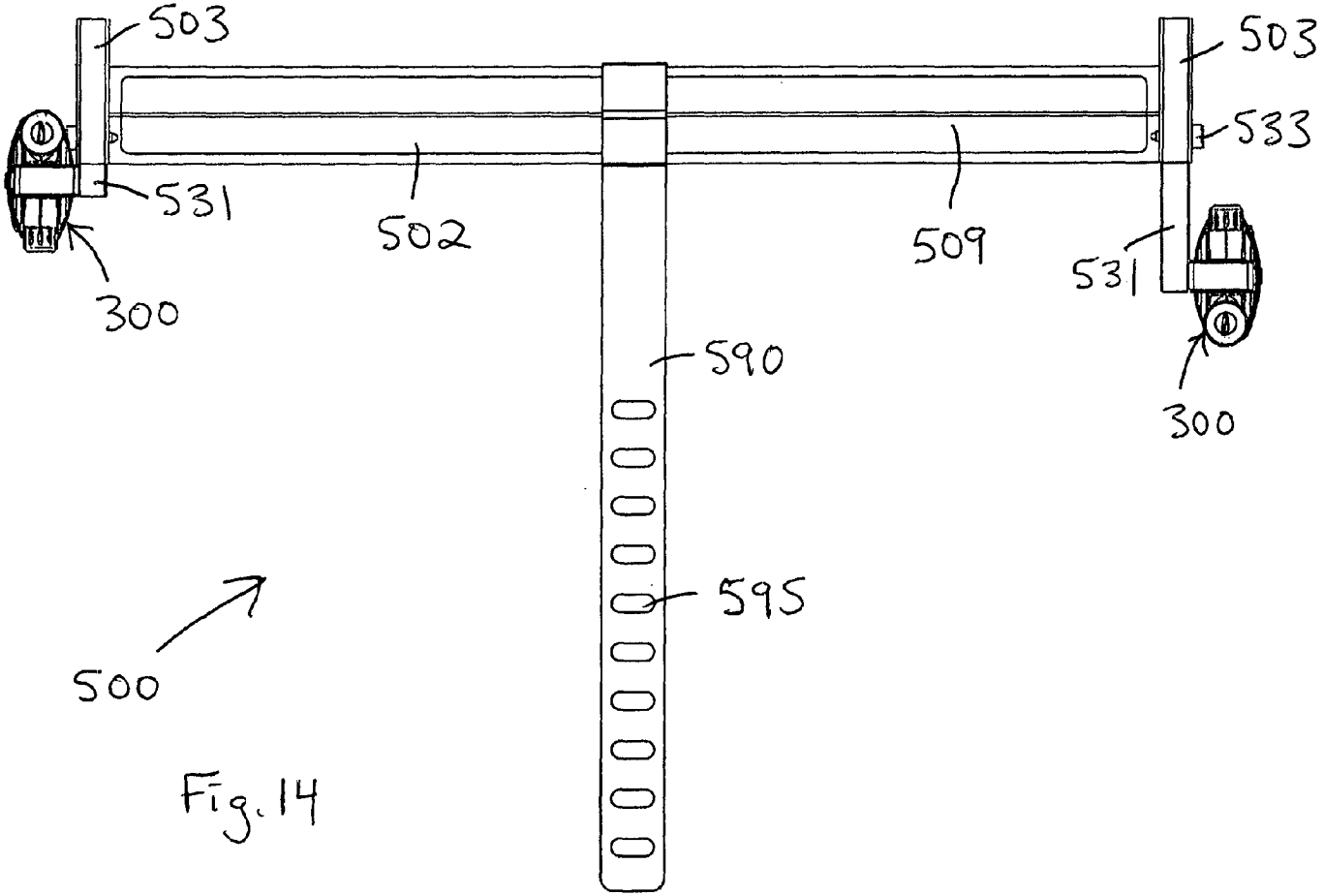
FIG. 14 is a top view of the embodiment shown in FIG. 13.

The receptacle 530 is sized and configured to selectively receive and retain the resistance device 300 in the same manner as the receptacles 230 shown in FIGS. 1-2. Accordingly, each latch member 536 has an integrally formed leaf spring latch 538 on a lower end of the latch member 826. On this embodiment, the steel frame member 534 reinforces the plastic latch member 536. The telescoping supports 531 allow the resistance devices 300 to be repositioned forward or backward relative to the person's feet F1 and F2. In FIG. 14, one of the supports 531 is shown in a relatively extend position, and the other support 531 is shown in a relatively retracted position. Also, one of the resistance devices 300 is flipped relative to the other to emphasize the versatility of the mounting arrangement.

Figure 17:
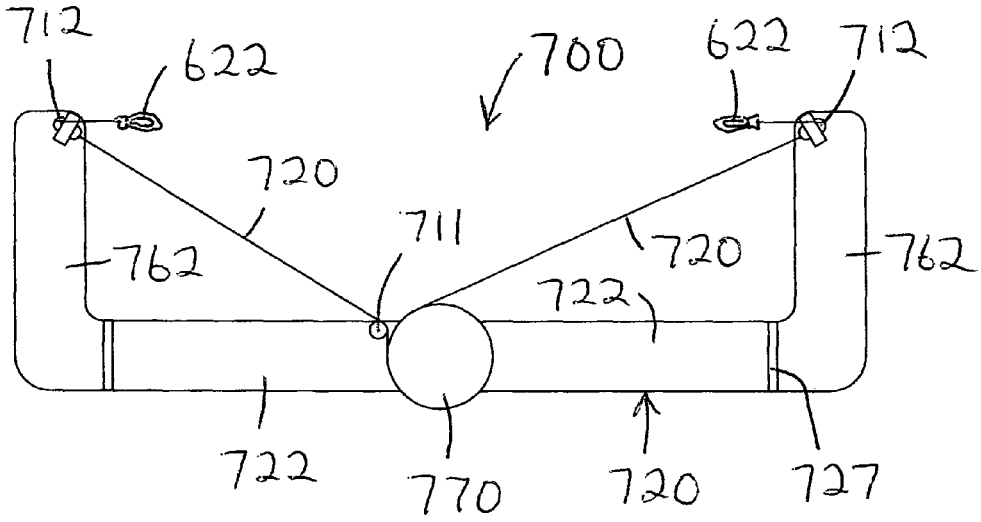
FIG. 17 is a perspective view of a person using yet another embodiment of the present invention.

FIG. 17 shows an alternative embodiment exercise apparatus 700 constructed according to the principles of the present invention. The exercise assembly 700 includes a U-shaped base member 720 that is preferably stamped from a sheet of steel. A resistance device 770 is secured in place at a central location on the U-shaped member 720. On opposite sides of the resistance device 770, left and right intermediate portions of the base member 720 define respective left and right foot platforms 722 that are sized and configured to support the left and right feet of the person P assuming a conventional golf stance. Optional left and right stops or flanges 727 extend upward from the base member 720 at the outer ends of respective foot platforms 722. The flanges 727 provide bearing surfaces against which the person P may press the side of his foot F1 or F2, if desired. The flanges 727 are rigidly secured to the base member 720, but may be selectively movable along the base member 720 on an alternative embodiment.

A pulley guide 711 is mounted on the base member 720, proximate one side of the resistance device 770, to re-route a flexible member 720 emanating from the resistance device 770. A second flexible member 720 emanates from the resistance device 770 proximate the pulley guide 711.

The resistance device 770 is functionally similar to the isokinetic resistance devices disclosed in U.S. Pat. No. 5,511,740 to Loubert et al., which is incorporated herein by reference. Persons skilled in the art will recognize that the resistance devices shown in FIG. 6-9 may be modified, as suggested by Loubert et al., to include a second flexible member, second sheave, second one-way clutch bearing, and second rewind spring, and used in place of the resistance device 770 on the embodiment 700 to create an alternative embodiment. Moreover, two of the Loubert et al. resistance devices may be modified, as suggested by this disclosure, to eliminate a respective flexible member, a respective sheave, a respective one-way clutch bearing, and a respective rewind spring, and used in place of respective resistance devices 600 on the preferred embodiment 100 to create another alternative embodiment. Still other embodiments may be derived by using other types of resistance devices, including simply the coiled spring 690 (without any band brake arrangement).

The base member 720 has first and second distal end portions 762 that extend from respective ends of the foot platforms 722 to respective distal ends. A left pulley guide 712 is secured in place on the distal end of the left end portion 762, and a right pulley guide 712 is secured in place on the distal end of the right end portion 762. One flexible member 720 is routed from the resistance device 770, about the pulley guide 711, about the nearer pulley guide 712, to a distal end that is secured to a first carabineer 622. The other flexible member 720 is routed from the resistance device 770, about the other pulley guide 712, to a distal end that is secured to another carabineer 622.

A person uses the exercise assembly 700 in the same manner as the exercise assembly 100 described above. In other words, the carabineers 622 may be secured to a golf club handle or other desired force receiving member. Contrary to the resistance devices 300 and 600, the resistance device 770 provides resistance as a function of how much force is applied to the flexible members 720. As noted above, persons skilled in the art will recognize that additional embodiments may be made by using left and right, single cable versions of the resistance device 770, or a dual cable version of the resistance devices 300 or 600, or different types and/or numbers of resistance devices.

Figure 18:
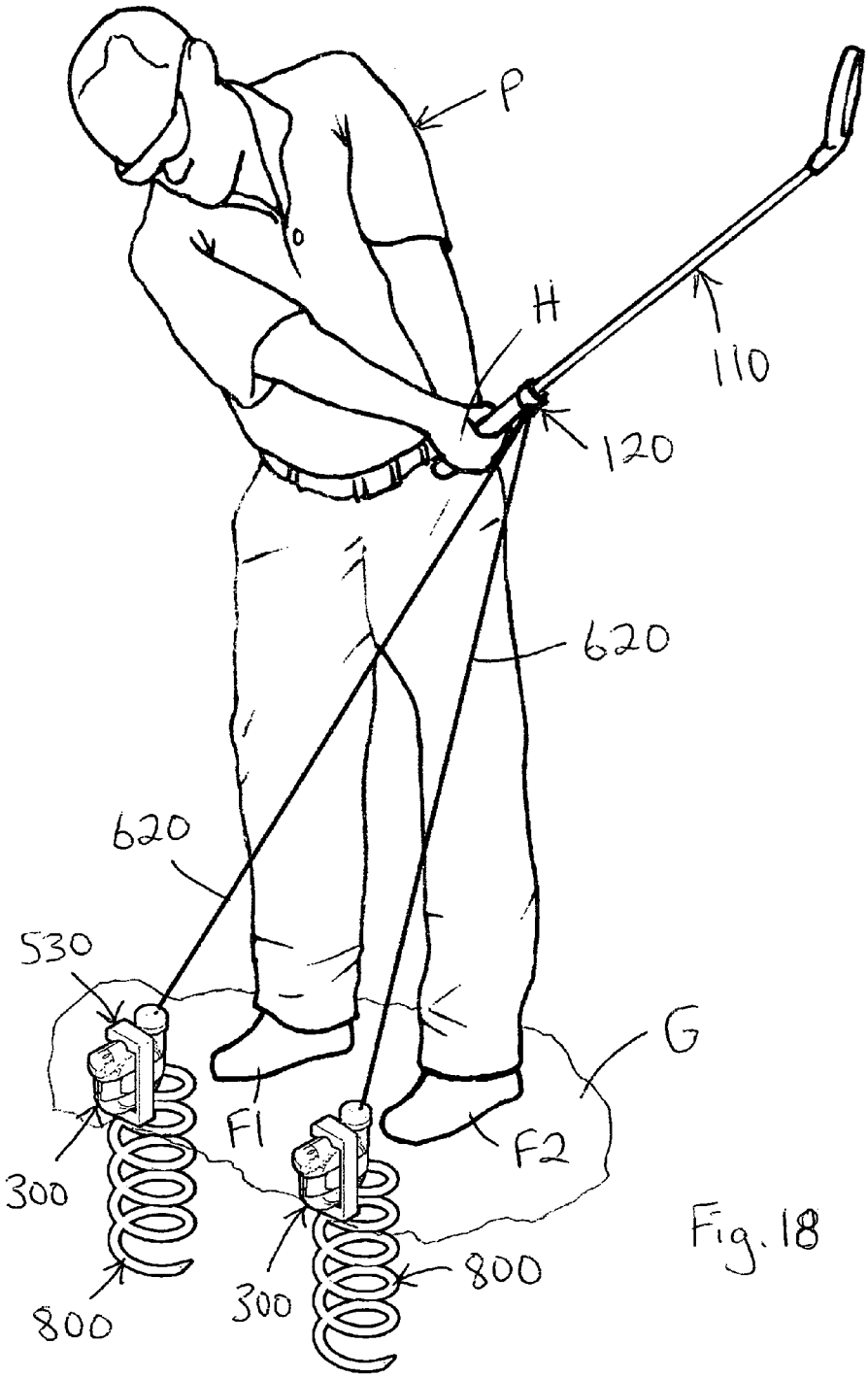
FIG. 18 is a perspective view of a person using still another alternative embodiment of the present invention.
Figure 19:
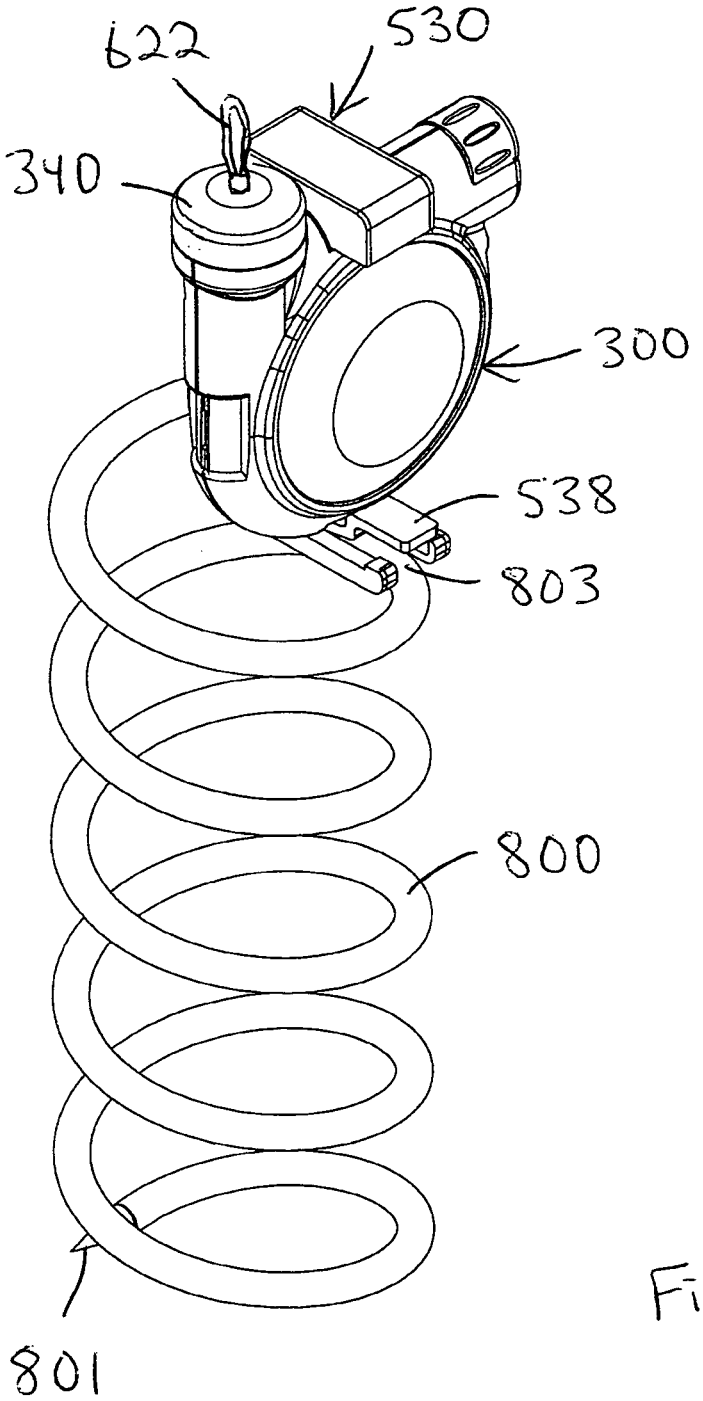
FIG. 19 is a perspective view of an exercise apparatus constructed according to the principles of the present invention and shown in FIG. 18.
Figure 20:
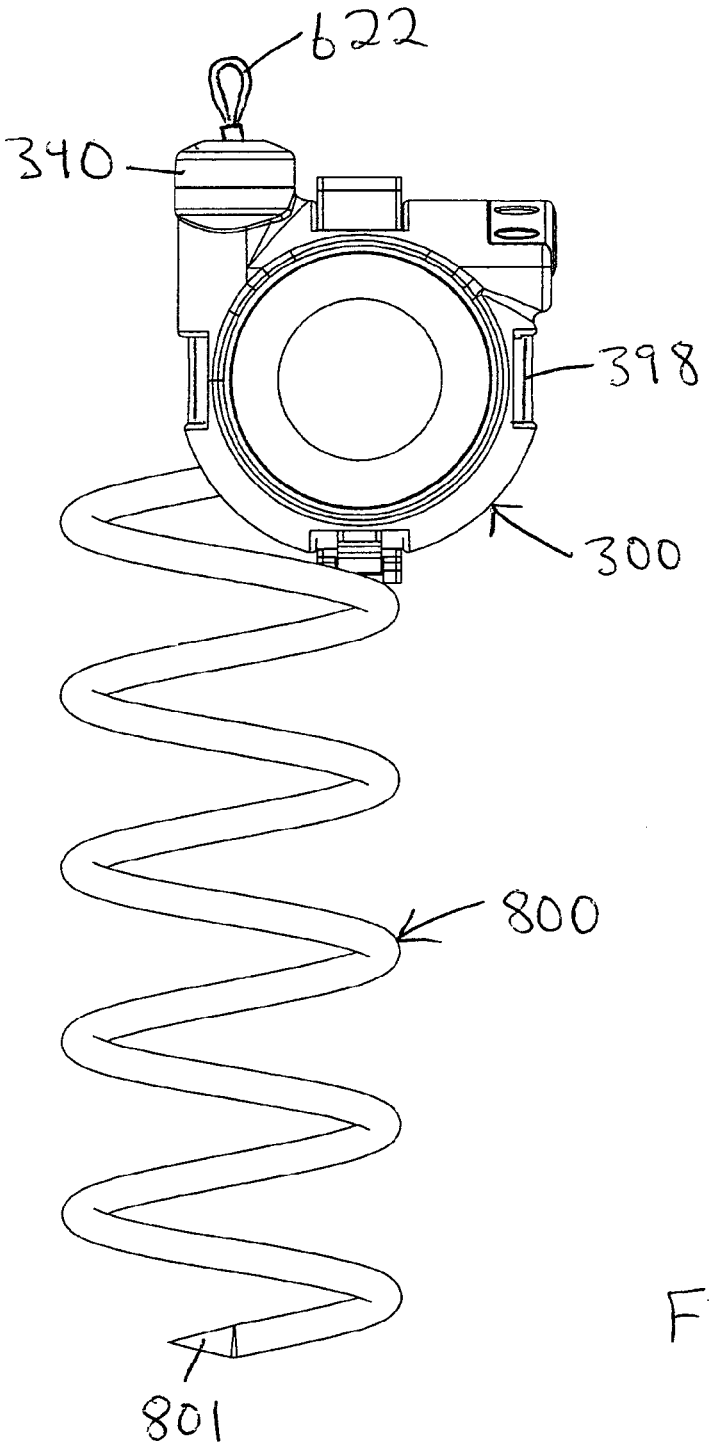
FIG. 20 is a front view of the exercise apparatus of FIG. 19.

FIG. 18 shows the person P performing a golf swing exercise according to the principles of the present invention. As in FIG. 1, the person P has assumed a conventional golf stance with a first resistance device 300 secured in place proximate his left foot F1, and a second resistance device 300 secured in place proximate his right foot F2. A flexible member 620 emanates from the first resistance device 300 and is connected to the handle of the golf club 110. Similarly, a flexible member 620 emanates from the second resistance device 300 and is connected to the handle of the golf club 110. With his hands H occupying a conventional grip on the handle of the golf club 110, the person P has moved the golf club 110 in a manner consistent with at least a portion of a conventional golf swing.

As shown in FIGS. 18-21, each resistance device 300 is mounted on an upper end 803 of a respective base member 800. As suggested by the common reference numerals, each resistance device 300 is releasably mounted on a respective base member 800 by means of a respective receptacle 530. Each resulting assembly may be described as an exercise apparatus constructed according to the principles of the present invention.

Figure 21:
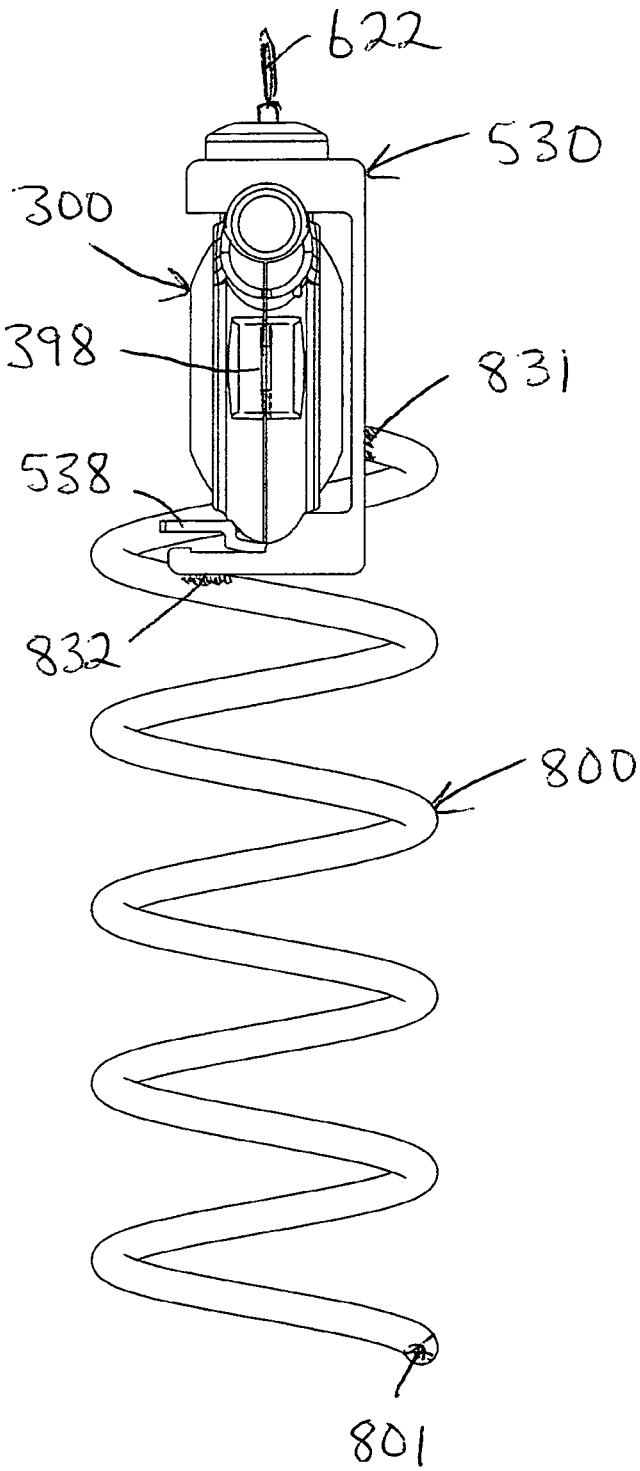
FIG. 21 is an end view of the exercise apparatus of FIG. 19.

Each base member 800 is preferably a steel rod that has been formed into a helical shape. A lower end 801 of each base member 800 is preferably pointed to facilitate passage through turf and underlying dirt. As shown in FIG. 21, the upper end 803 of each base member 800 is preferably configured and arranged to bear against and be welded to two separate portions 831 and 832 of a respective C-shaped frame member 534 (which may be augmented for connection to the base member 800). As shown in FIG. 18, each base member 800 is screwed into the ground G (preferably through turf and into underlying dirt). The resistance device 300 is preferably mounted on the base member 800 in a manner that aligns the axis defined by rotation of the re-directional bearing relative to the housing 392 with the axis defined by rotation of the base member 800 relative to the ground G.

In an alternative application, at least one base member 800 is anchored in a footing, preferably concrete, that extends downward into the ground G. This approach ensures stability of the base members 800, and still allows the person P to adjust relative to the base members 800. Moreover, the resistance devices 300 may be readily removed from the base member 800 to protect them from the elements, theft, and other forms of harm.

Figure 22:
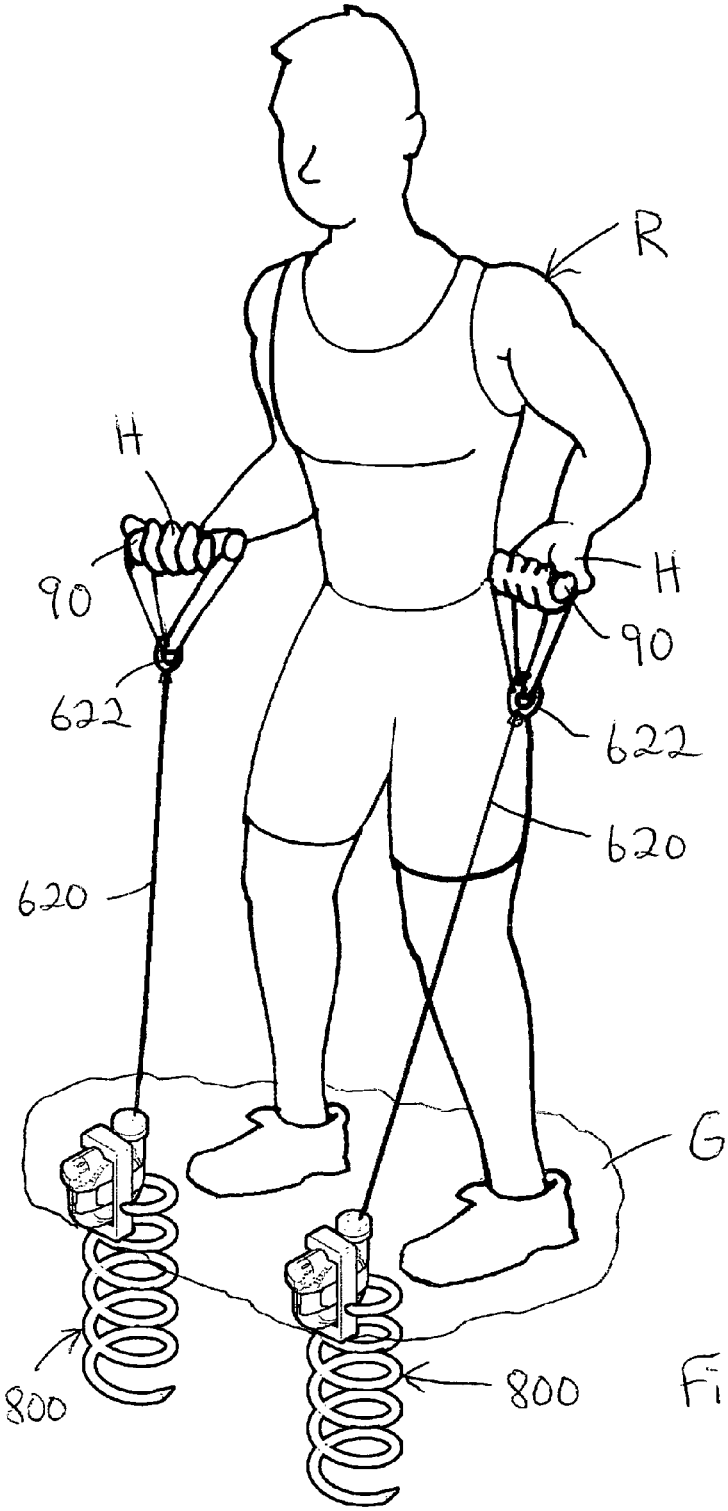
FIG. 22 is a perspective view of a person using two of the exercise apparatus of FIG. 19 to perform a different sort of exercise.

FIG. 22 shows a person R standing on the ground G in proximity to two of the exercise apparatus described with reference to FIGS. 18-21. Instead of performing a golf swing exercise, the person R is performing a more traditional type of upper body exercise. In this regard, otherwise conventional exercise handles 90 are connected to respective left and right carabineers 622. The person R is holding a respective handle 90 in each hand H, and is pulling upward on the handles 90.

Figure 23:
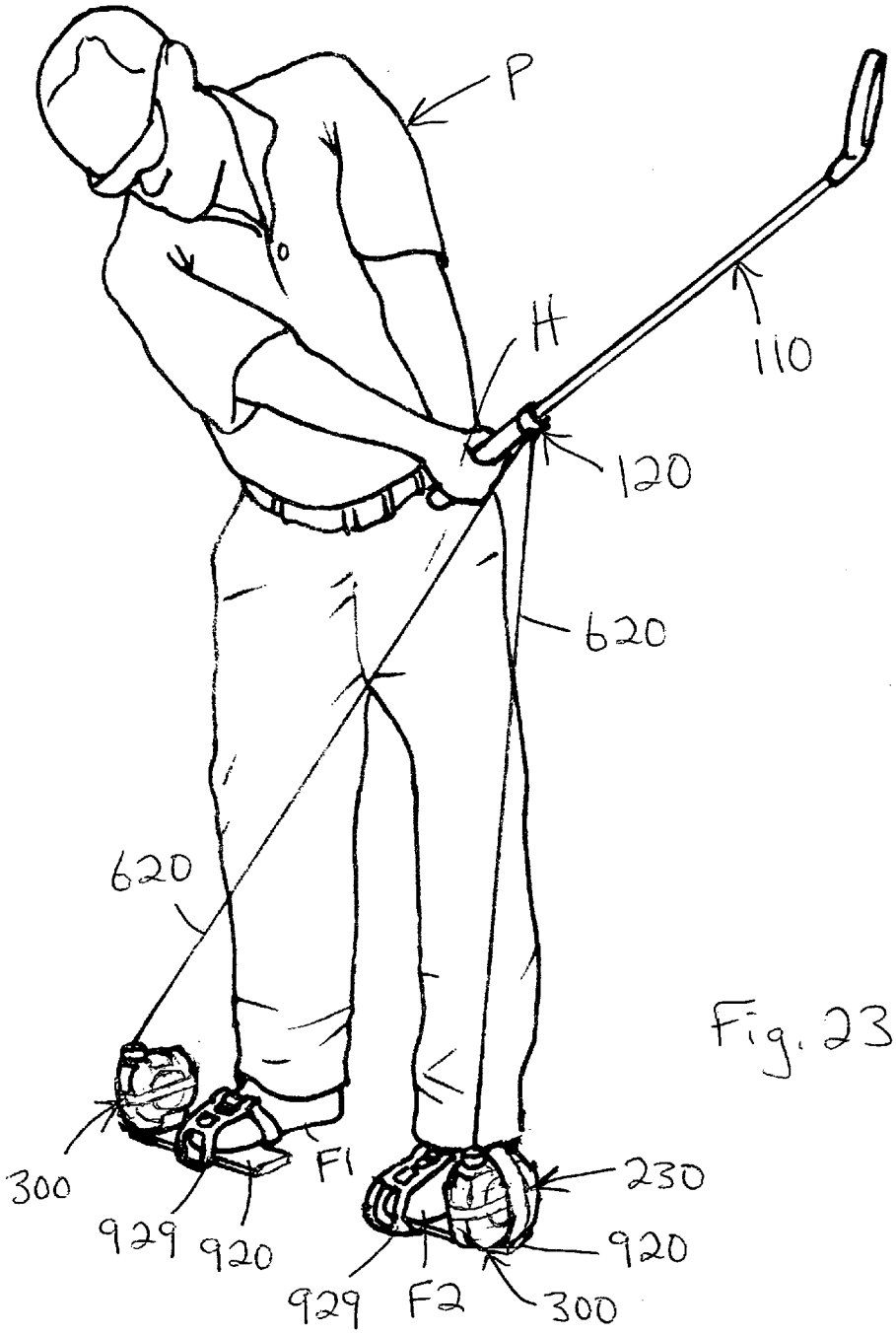
FIG. 23 is a perspective view of a person performing a golf swing exercise in accordance with the principles of the present invention.

FIG. 23 shows a person P performing a golf swing exercise in much the same manner as the person P shown in FIG. 1. As suggested by the common reference numerals, the person P is using many of the same components, as well. However, the base member 200 is replaced by separate left and right base members 920, and an otherwise conventional toe cup 929 is mounted on each base member 920, preferably by means that accommodates selective rotation of the former relative to the latter (as further discussed below). The toe cups 929 help locate and retain the person's feet relative to the respective base members 920. An advantage of this arrangement is that the person P can adjust his feet F1 and F2 with relatively greater freedom, and the product can be shipped and stored in a relatively smaller amount of space. Persons skilled in the art will also recognize that the toe cups 929 may be rotated relative to the respective base members 920 to place the resistance devices 300 directly in front of the person's respective feet F1 and F2. On a preferred version of this embodiment, such reorientation is at the discretion of the person P, in response to releasing a latch. However, the orientation may be fixed as shown or in another orientation on alternative embodiments.

Persons skilled in the art will recognize that the subject present invention may be described in terms of methods with reference to the foregoing embodiments. For example, the present invention may be described in terms of a method of performing a golf swing exercise, comprising the steps of assuming a conventional golf stance with a first resistance device secured in place proximate one's left foot, and with a second resistance device secured in place proximate one's right foot; securing a flexible member from the first resistance device to a golf club handle; securing a flexible member from the second resistance device to the golf club handle; and moving the golf club handle in a manner consistent with at least a portion of a conventional golf swing. The assuming step may involve placing a base member on an underlying support surface, and standing on the base member in said conventional golf stance. Alternatively, the assuming step may involve anchoring each said resistance device relative to an underlying support surface, and standing on the support surface in said conventional golf stance. Each said securing step may involve releasably connecting a respective said flexible member to a conventional golf club proximate a lower end of a grip portion of said club. For example, a non-invasive fastener may be releasably connected to said club, and each said flexible member may be releasably connected to the fastener.

The present invention may also be described in terms of a method of performing a golf swing exercise, comprising the steps of assuming a conventional golf stance with a first resistance cord supported at a location proximate one's left toes, and with a second resistance cord supported at a location proximate one's right toes; securing the first resistance cord to a golf club handle; securing the second resistance device cord to the golf club handle; and moving the golf club handle in a manner consistent with at least a portion of a conventional golf swing.

Persons skilled in the art will also recognize that various modifications may be made to the foregoing embodiments, and that different sorts of resistance devices and force receiving members may be used in lieu of and/or in addition to those disclosed herein, and that features and uses of all relevant embodiments may be mixed and matched to arrive at more embodiments. In view of the foregoing, the subject invention should be limited only to the extent of the claims set forth below.

What is claimed is:

1. An exercise apparatus, comprising:

a base sized and configured to rest in a stable position on a flat underlying surface and accommodate a person's left foot and right foot in a conventional golf stance for execution of a conventional golf swing;

a handle sized and configured to accommodate a person's left hand and right hand in a conventional golf grip;

a first bracket mounted on a left end of the base;

a second bracket mounted on a right end of the base;

a first resistance device mounted on the first bracket, wherein the first resistance device includes a first routing member and a first flexible member, and the first flexible member extends from the first routing member to a distal end connected to the handle; and a second resistance device mounted on the second bracket, wherein the second resistance device includes a second routing member and a discrete, second flexible member, and the second flexible member extends from the second routing member to a distal end connected to the handle, and each said routing member is repositionable relative to the base between a first fixed location and a relatively more forward, second fixed location relative to a respective said foot.

2. The exercise apparatus of claim 1, wherein the first flexible member extends from a position forward and leftward of the person's left foot to a position proximate a lower end of a hand grip portion of the handle, and the second flexible member extends from a position forward and rightward of the person's right foot to a position proximate a lower end of a hand grip portion of the handle.

3. The exercise apparatus of claim 1, wherein each said resistance device includes a housing, a sheave rotatably mounted inside the housing, and a rewind spring interconnected between the sheave and the housing, wherein each said flexible member is wound about a respective said sheave.

4. The exercise apparatus of claim 3, wherein each said housing is selectively removable from the base, shrouds all sides of the sheave, and is sized and configured to be held by a person's hand when removed from the base.

5. The exercise apparatus of claim 4, wherein a strap is secured across an outer side of one said housing to accommodate and releasably retain a person's hand between the strap and the outer side.

6. The exercise apparatus of claim 4, wherein a latching member is provided on of the base and one said housing to latch the one said housing relative to a respective said bracket.

7. The exercise apparatus of claim 1, wherein each said resistance device is selectively removable from a respective said bracket, and the left resistance device is mounted in a first orientation on the first bracket to position the first routing member in a respective said first fixed location, and the left resistance device is mounted in a second orientation on the first bracket to position the first routing member in a respective second said fixed location.

8. The exercise apparatus of claim 1, wherein each said bracket is selectively movable relative to the base, and the first bracket is moved to a first position relative to the base to position the first routing member in a respective said first fixed location, and the first bracket is moved to a second position relative to the base to position the first routing member in a respective said second fixed location.

9. An exercise system for golf swing training, comprising:

a conventional golf club having a hand grip portion sized and configured to accommodate a person's left hand and right hand in a conventional golf grip;

at least one resistance device, wherein the at least one resistance device includes a left flexible member that extends from a left routing member to a connection point on the golf club, and a right flexible member that extends from a right routing member to a connection point on the golf club, wherein each said connection point is disposed proximate a lower end of the hand grip portion; and at least one base, wherein the at least one base is sized and configured to accommodate a person's left foot and right foot in a conventional golf stance in contact with an underlying ground surface while executing a conventional golf swing with the left routing member anchored in a forward leftward position relative to the person's left foot and the right routing member anchored in a forward rightward position relative to the person's right foot, and the at least one base includes an intermediate strip, a left bracket secured to a left end of the intermediate strip, and a right bracket secured to a right end of the intermediate strip, wherein the intermediate strip cooperates with each said bracket to define a generally U-shaped configuration, and the left routing member is disposed at a left distal end of the generally U-shaped configuration, and the right routing member is disposed at a right distal end of the generally U-shaped configuration.

10. The exercise system of claim 9, wherein the at least one resistance device includes a left housing and a right housing, a separate sheave rotatably mounted inside each said housing, a separate re-wind spring disposed inside each said housing and operatively interconnected between a respective said sheave and a respective said housing, and each said flexible member has an inboard end connected to a respective said sheave, and an intermediate portion wrapped about a respective said sheave.

11. The exercise system of claim 10, further comprising a separate braking member rotatably mounted inside each said housing, wherein each said sheave rotates in a flexible member extraction direction together with a respective said braking member, and each said sheave rotates in an opposite, flexible member retraction direction relative to a respective said braking member.

12. The exercise system of claim 10, wherein a latch member is movably mounted on one of the left housing and said at least one base, for selective movement between a first position, wherein the latch member locks the left housing to said at least one base, and a second position, wherein the latch member releases the left housing for removal from said at least one base.

13. An exercise apparatus, comprising:

an elongate strip sized and configured to rest in a stable orientation on a flat surface and to accommodate a person's left foot and right foot standing on both the strip and the surface, wherein the strip has a left end and an opposite, right end;

at least one handle;

a left bracket movably mounted on the left end of the strip;

a right bracket movably mounted on the right end of the strip, wherein each said bracket selectively telescopes relative to the strip in a direction perpendicular to the strip and parallel to the surface;

a first resistance device mounted on the left bracket, wherein the first resistance device includes a flexible member having a distal end connected to the at least one handle; and a second resistance device mounted on the right bracket, wherein the second resistance device includes a discrete flexible member having a distal end connected to the at least one handle.

14. The exercise apparatus of claim 13, wherein each said resistance device includes a housing, a sheave rotatably mounted inside the housing, and a re-wind spring interconnected between the sheave and the housing, wherein each said flexible member has an opposite, inboard end connected to a respective said sheave.

15. The exercise apparatus of claim 14, wherein each said bracket includes a latch that deflects to accommodate insertion and removal of a respective said housing.

16. The exercise apparatus of claim 14, wherein each said housing is selectively removable from a respective said bracket, and sized and configured to be hand-held and moved together with a person's respective hand for exercise purposes, and a strap is secured across an outer side of one said housing to accommodate and releasably retain a person's hand between the strap and the outer side of the one said housing.

17. An exercise system for golf swing training, comprising:

a base configured to anchor a support bracket forward of a foot of a person standing at least in part on an underlying ground surface in a conventional golf stance and executing a golf swing;

a resistance device including a housing, a sheave rotatably mounted inside the housing, a re-wind spring disposed inside the housing and operatively interconnected between the sheave and the housing, and a flexible member having an inboard end connected to the sheave, an intermediate portion wrapped about the sheave, and an opposite, distal end emanating from the housing;

a conventional golf club connected to the distal end of the flexible member; and a latch member movably mounted on one of the housing and the support bracket for selective movement between a first position, wherein the latch member locks the housing to the support bracket, and a second position, wherein the latch member releases the housing for removal from the support bracket.

18. The exercise system of claim 17, wherein a strap is secured across an outer side of said housing to accommodate and releasably retain a person's hand between the strap and the outer side for alternative exercise purposes when the housing is removed from the support bracket.

19. The exercise system of claim 17, wherein the flexible member emanates from the housing at a first location relative to the base when the housing is mounted in a first orientation on the support bracket, and the flexible member emanates from the housing at a discrete, second location relative to the base when the housing is alternatively mounted in a discrete, second orientation on the support bracket.

* * * * *